US006933824B2

(12) United States Patent
Marusinec et al.

(10) Patent No.: US 6,933,824 B2
(45) Date of Patent: Aug. 23, 2005

(54) POLYMER SHEET CORE AND COIL INSULATION FOR TRANSFORMERS

(75) Inventors: Richard M. Marusinec, Delafield, WI (US); Stewart W. Durian, Sussex, WI (US); David J. Rolling, Waukesha, WI (US)

(73) Assignee: McGraw-Edison Company, Houston, TX (US)

( * ) Notice: Subject to any disclaimer, the term of this patent is extended or adjusted under 35 U.S.C. 154(b) by 0 days.

(21) Appl. No.: 10/640,276

(22) Filed: Aug. 14, 2003

(65) Prior Publication Data

US 2004/0150498 A1 Aug. 5, 2004

Related U.S. Application Data

(60) Provisional application No. 60/444,968, filed on Feb. 5, 2003.

(51) Int. Cl.[7] ..... H01F 27/30
(52) U.S. Cl. ..... 336/198; 336/207
(58) Field of Search ..... 336/55, 61, 65, 336/83, 90–96, 196–199, 207, 206, 208

(56) References Cited

U.S. PATENT DOCUMENTS

| | | | | |
|---|---|---|---|---|
| 4,673,907 A | * | 6/1987 | Lee | 336/92 |
| 4,833,436 A | | 5/1989 | Martin et al. | |
| 4,837,543 A | | 6/1989 | Humen et al. | |
| 4,890,086 A | | 12/1989 | Hill | |
| 5,194,841 A | | 3/1993 | Galloway et al. | |
| 5,319,341 A | | 6/1994 | Bisbee et al. | |
| 5,684,446 A | | 11/1997 | Adkins et al. | |
| 6,424,246 B1 | | 7/2002 | Kysely et al. | |

* cited by examiner

*Primary Examiner*—Tuyen T Nguyen
(74) *Attorney, Agent, or Firm*—Fish & Richardson P.C.

(57) ABSTRACT

A transformer includes a core defining a core window, a first coil surrounding a portion of the core and including a portion located within the core window, a second coil surrounding a portion of the core and including a portion located within the core window, and a polymer barrier insulation member that is located at least partially within the core window and positioned between the first coil and the second coil.

42 Claims, 20 Drawing Sheets

300

600

700

800

900

1300

Section A-A

1600

1700

1800

POLYMER SHEET CORE AND COIL INSULATION FOR TRANSFORMERS

CROSS REFERENCE TO RELATED APPLICATIONS

This application claims priority from U.S. Provisional Application No. 60/444,968, filed Feb. 5, 2003, and titled "Polymer Sheet Core and Coil Insulation For Liquid Filled Transformers," which is incorporated by reference.

TECHNICAL FIELD

The description below relates to polymer sheet insulation for use with a transformer core and coil assembly.

BACKGROUND

Transformers often include a core and coil assembly formed from a pair of coils interconnected by a conductive core. A three phase transformer includes three coils with multiple cores. The core and coil assembly may be positioned in a tank that is filled with a dielectric fluid. The dielectric fluid serves to cool the assembly and electrically isolate the core and coil assembly from the tank.

Insulation used in the transformer core and coil assembly typically is constructed using kraft or cotton-based pressboard, which is known to degrade over time as a function of temperature. This insulation normally is made from multiple individual pieces that may require cutting to the correct size. Also, the insulation needs to be thoroughly dried prior to filling the tank with dielectric fluid because moisture contributes to and increases the degradation rate, especially when combined with heat. Typical kraft-based pressboard materials absorb moisture in a range from approximately 3% to 10%, or more, based on the length of exposure to humidity. This moisture should be removed to a level of approximately 1% prior to filling the transformer with dielectric fluid. Current kraft or cotton-based pressboard material absorbs moisture and degrades rapidly at temperatures from 130° C. to 170° C. Further moisture developed during the degradation process of kraft or cotton-based pressboard, accelerates aging and degradation of the pressboard.

SUMMARY

Techniques are used to provide a polymer sheet core and coil insulation for transformers such as, for example, single-phase and multi-phase transformers. The polymer sheet core and coil insulation may be used, for example, as a barrier insulation including use as a phase-to-phase barrier insulation and as a phase-to-ground barrier insulation, and further may be used as a transformer coil support.

In one general aspect, a transformer includes a core defining a core window, a first coil surrounding a portion of the core and including a portion located within the core window, a second coil surrounding a portion of the core and including a portion located within the core window, and a polymer barrier insulation member that is located at least partially within the core window and positioned between the first coil and the second coil.

Implementations may include one or more of the following features. For example, the transformer may be a three phase transformer, a single phase transformer, or a step voltage regulator. The polymer barrier insulation member may include at least one ribbed polymer sheet, at least one flat polymer sheet, and/or two or more stacked polymer sheets.

The polymer barrier insulation member may be made of a high temperature polymer configured to withstand an operating temperature of approximately 130 degrees Celsius, may be configured to withstand overload conditions through approximately 200 degrees Celsius, and may be configured so as to absorb no more than approximately 1% moisture. The high temperature polymer may be, for example, syndiotactic polystyrene, a polyester thermoset molding compound, or a vinylester thermoset molding compound. The high temperature polymer may be made using a variety of techniques and, for example, may be extruded, injection molded, compression molded or thermo-formed.

In another general aspect, a transformer includes a core defining a core window, a first coil surrounding a portion of the core and including a portion located within the core window, and a polymer barrier insulation member that is located at least partially within the core window and positioned between the first coil and the core.

In another general aspect, a transformer includes a core defining a core window, a first coil surrounding a portion of the core and including a portion located within the core window, and a polymer coil support member that is located at least partially within the core window and positioned between the first coil and the core so as to support the first coil.

Implementations may include one or more of the following features. For example, the transformer also may include a second coil surrounding a portion of the core and including a portion located within the core window, where the coil support is positioned between the second coil and the core so as to support the second coil. In another implementation, the coil support member includes one or more standoffs. The standoffs may have several shapes such as, for example, a circular shape, a truncated circular shape, or an egg crate shape.

The coil support member may include one or more coolant flow channels, and may be made, for example, of a thermoset material or a high temperature thermoplastic material. In one implementation, the coil support member is made of a high temperature polymer material configured to withstand an operating temperature of approximately 130 degrees Celsius.

In yet another general aspect, a transformer includes a core defining a core window, a first coil surrounding a portion of the core and including a portion located within the core window, a second coil surrounding a portion of the core and including a portion located within the core window, a first polymer barrier insulation member that is located at least partially within the core window and positioned between the first coil and the second coil, a second polymer barrier insulation member that is located at least partially within the core window and positioned between the first coil and the core, and a polymer coil support member that is located at least partially within the core window and positioned between the first coil and the core so as to support the first coil.

Other features will be apparent from the description and drawings, and from the claims.

DESCRIPTION OF DRAWINGS

Like reference symbols in the various drawings indicate like elements.

DETAILED DESCRIPTION

Figure 1:
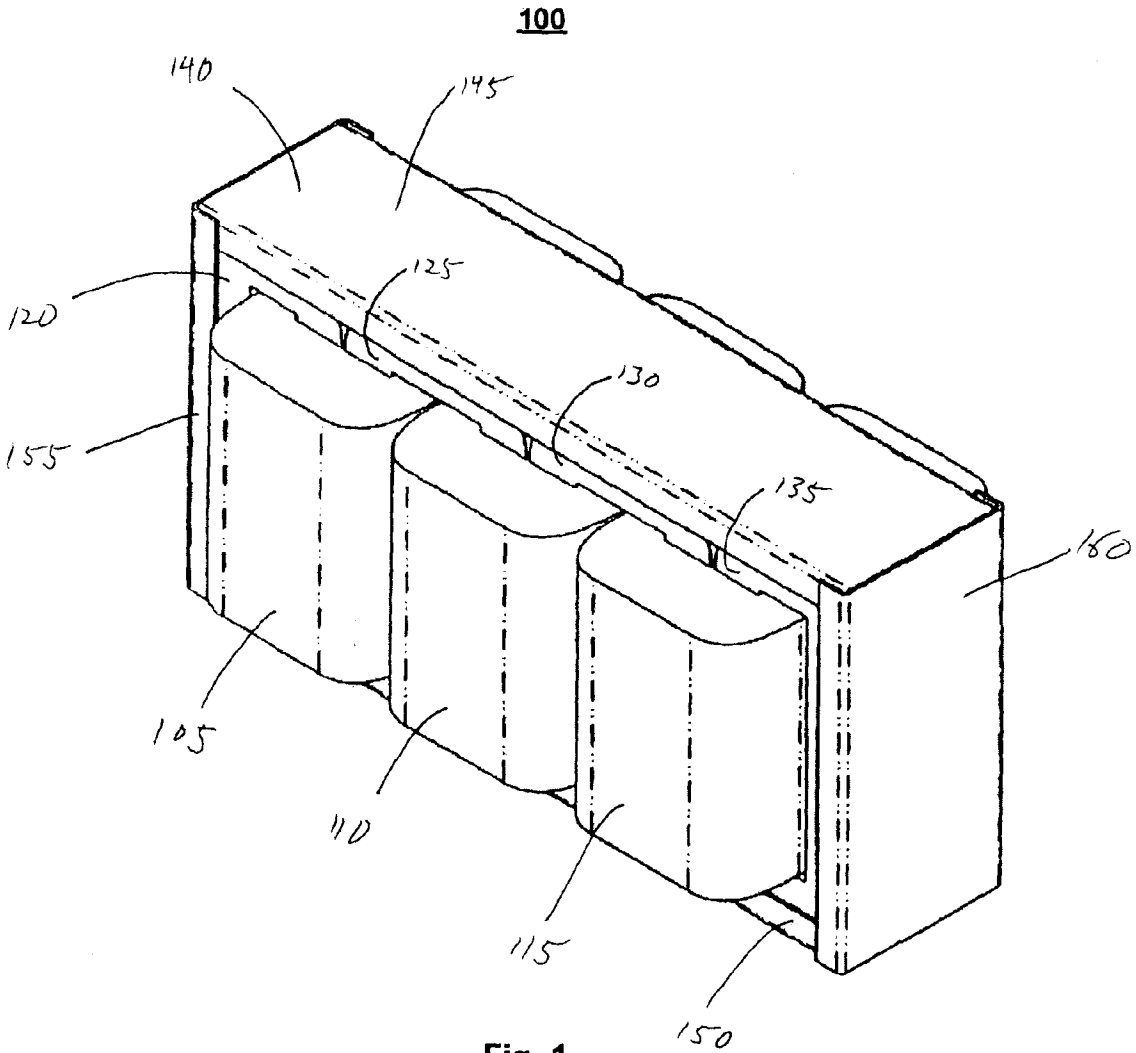
FIG. 1 is a perspective view of a three phase transformer core and coil assembly.

Referring to FIG. 1, a transformer core and coil assembly 100 includes coils 105, 110 and 115 and cores 120, 125, 130 and 135. A frame 140 surrounds the cores and coils, and includes a top 145, a bottom 150, and sides 155 and 160. As shown, the transformer core and coil assembly 100 is for a three-phase transformer. Each of coils 105, 110 and 115 includes a primary winding and one or more secondary windings for an individual phase of a three-phase system. The transformer core and coil assembly 100 typically is placed in a tank and immersed in a dielectric fluid (not shown). The transformer core and coil assembly 100 may be used in applications such as, for example, distribution and power transformers, and in one example, may include core and coil assemblies having operating ratings through 10,000 kVA.

Figure 2:
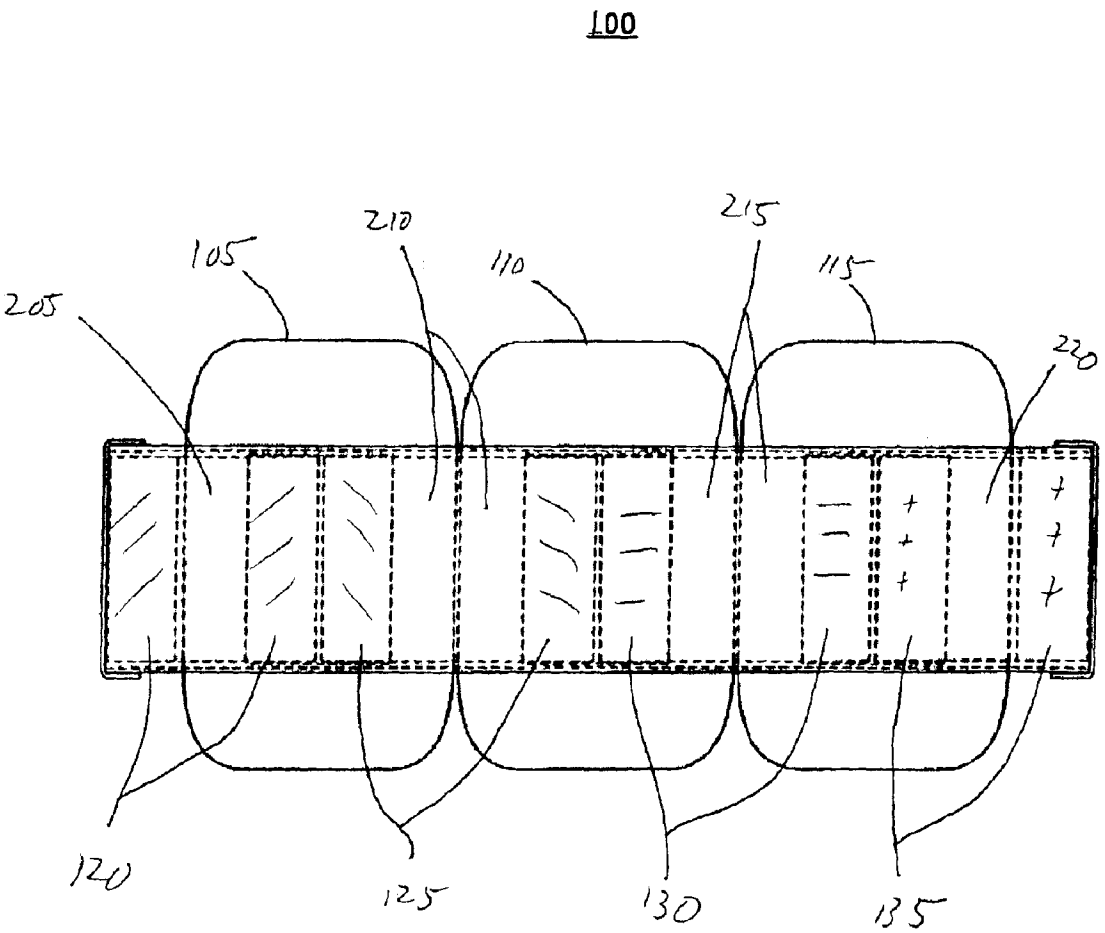
FIG. 2 is a cut-away top view of the three phase transformer core and coil assembly of FIG. 1.

FIG. 2 shows a cut-away top view of the three phase transformer core and coil assembly 100 of FIG. 1. As shown in FIG. 2, core 120 defines a core window 205 through which at least a part of coil 105 extends. Core 125 defines a core window 210 through which at least a part of coil 105 and at least a part of coil 110 extend. Core 130 defines a core window 215 through which at least a part of coil 110 and at least a part of coil 115 extend. Core 135 defines a core window 220 through which at least a part of coil 115 extends. Each of coils 105, 110 and 115 is associated with a different phase of a three-phase system.

Figure 3:
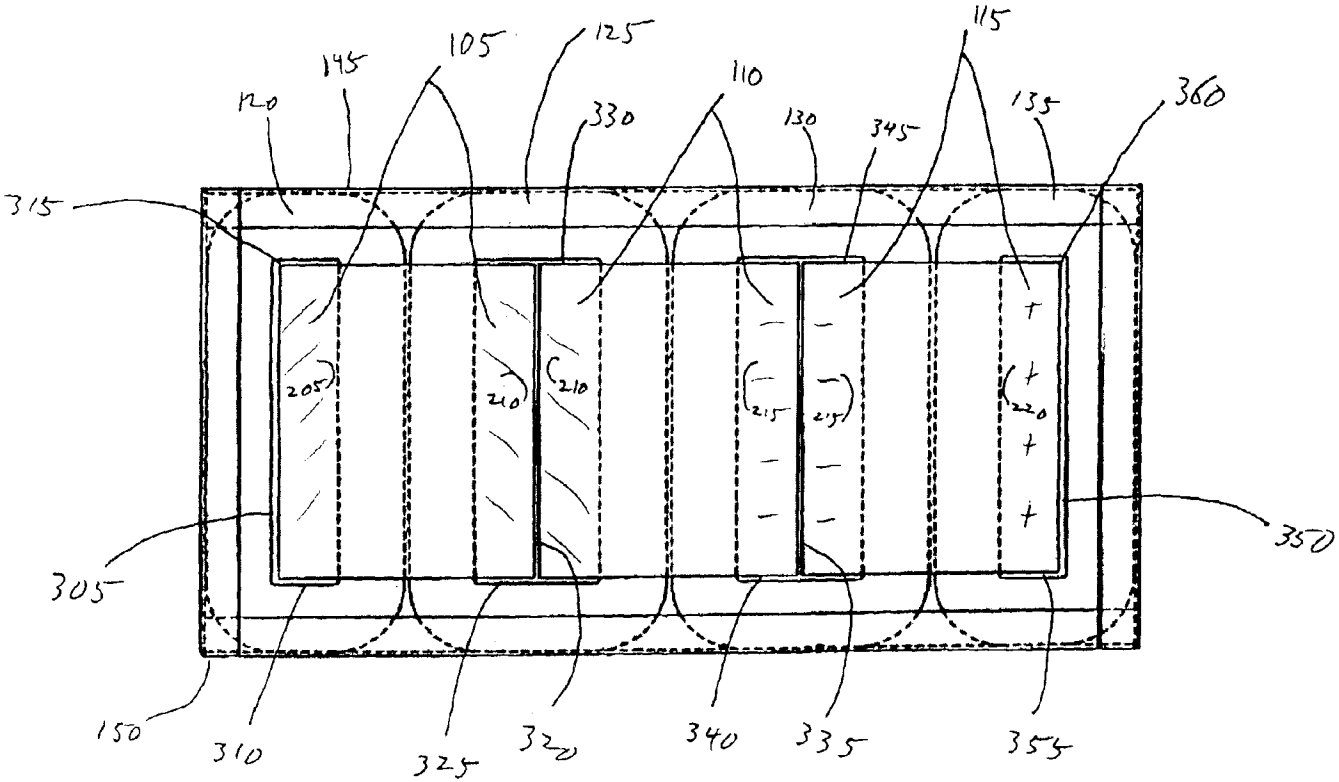
FIG. 3 is a cut-away side view of the three phase transformer core and coil assembly of FIGS. 1 and 2.

FIG. 3 illustrates a cut-away side view of the three-phase transformer core and coil assembly 100 of FIGS. 1 and 2. As shown, core window 205 of core 120 contains at least a portion of coil 105, barrier insulation 305, a coil support 310, and barrier insulation 315.

Barrier insulation 305 is located adjacent coil 105 and between the coil 105 and the core 120 in the core window 205. Barrier insulation 305 serves as a coil-to-ground (core) barrier and is made of a polymer material. Barrier insulation 305 also provides dielectric and mechanical strength between the coil and the core. Typically, barrier insulation 305 is a flat or corrugated sheet. Cooling duct configurations may be included in the barrier insulation 305. Multiple pieces of barrier insulation may be used to fill the space to an appropriate thickness given the dielectric strength required. In certain implementations, the barrier insulation is made from interlocking pieces, such as, for example, corrugated pieces. In other implementations, the barrier insulation is made from flat pieces.

Coil support 310 is located between the coil 105 and the core 120 beneath the coil 105. Coil support 310 serves to support the weight of coil 105, and also serves as a dielectric barrier between the coil and the core. A barrier 315 may be located above coil 105 between coil 105 and core 120 in the core window 205.

Core window 210 of core 125 contains at least portions of coil 105, coil 110, barrier insulation 320, a coil support 325, and barrier insulation 330. Barrier insulation 320 is located between coil 105 and coil 110, and acts as a coil-to-coil insulation barrier. Barrier insulation 320 also provides dielectric and mechanical strength between the coils. In a similar manner to that described with respect to coil support 310, coil support 325 is located beneath at least a portion of coil 105 and at least a portion of coil 110, and serves to separate the coils 105 and 110 from the core 125. Barrier insulation 330 may be located on top of at least portions of coils 105 and 110, and serves to separate the coils 105 and 110 from the core 125 in a manner similar to that described with respect to barrier insulation 315.

Core window 215 of core 130 contains at least portions of coil 110, coil 115, barrier insulation 335, a coil support 340, and barrier insulation 345. Barrier insulation 335 may be placed between coil 110 and coil 115 in a manner similar to that described with respect to barrier insulation 320. Coil support 340 may be placed underneath a portion of coil 110 and a portion of coil 115 in a manner similar to that described with respect to coil support 325. Barrier insulation 345 may be placed on top of coil 110 and coil 115 in a manner similar to that described with respect to barrier insulation 330.

Core window 220 of core 135 contains at least portions of coil 115, barrier insulation 350, a coil support 355, and barrier insulation 360. Barrier insulation 350 is placed between coil 115 and core 135 in a manner similar to that described above with respect to barrier insulation 305. Coil support 355 is placed underneath coil 115 in a manner similar to that described above with respect to coil support 310. Barrier insulation 360 is placed on top of coil 115 in a manner similar to that described above with respect to barrier insulation 315.

Each of barrier insulation 305, 315, 320, 330, 335, 345, 350, and 360 is made of a polymer material. The polymer material may be, for example, a high temperature polymer with low water absorption properties. The polymer material used for insulation should have less than 1% moisture and should not absorb moisture when exposed to humid air. For example, it is possible to use a polymer material with less than 0.5% moisture. Temperatures of approximately 130° C.

to approximately 200° C. may exist in the areas of the barrier material, and it is beneficial to use a barrier polymer material that does not absorb moisture beyond the 0.5% level, and that operates at elevated temperatures from 130° C. through 200° C. with minimal degradation. Polymer materials that operate in a transformer for extended periods of time, during overload conditions, at temperatures from 130° C. through 170° C. and excursions through 200° C. are very desirable. The material should also be cost effective.

The polymer material reduces the need to dry the insulation prior to filling the transformer with dielectric fluid and thereby reduces the transformer manufacturing cycle time. The barrier insulation may be molded or extruded as a single part, and molding or extrusion can be used to add functionality, such as, for example, coolant flow channels, locating features, interlocking features, and stacking features.

In particular implementations, the polymer material is of a heat resistant type, such as, for example, Questra (syndiotactic polystyrene), high temperature nylon, PPS (polyphenylene sulfide), RADAL-R (polyphenylsulfone), or another appropriate heat resistant or thermoset material. The polymer material typically has a superior dielectric strength to allow for a reduction in thickness of the electrical insulation, and consequently to allow a size and weight reduction in the transformer. The barrier insulation may be used in multi-phase transformers, shell-type single phase transformers, and step voltage regulators, among other applications. The barrier insulation may be used for coil-to-coil insulation barriers and coil-to-ground (core) barriers. The barriers typically serve as barriers for dielectric and mechanical strength. Within the transformer coils 105, 110, and 115, polymer sheet wire spacers may be used to space sections of the windings apart from one another.

Polymer coil supports 310, 325, 340, and 355 each insulate a coil end from a core ground plane. The coil supports may be formed to have a minimally obstructed oil flow horizontally above and below the coil in the core window, which provides for consistent cooling with lower thermal gradients. The coil supports provide mechanical support for the coils in the core windows. Sufficient support area is provided to prevent the crushing of the coil margins. The coil supports are sufficiently rigid to withstand telescoping forces during short circuit. When multiple layers are stacked together, the coil supports are designed to minimize the probability of allowing individual layers to move axially in relation to each other during shipping or short circuit. The use of the polymer coil supports reduces stacking time through, among other things, part count reduction. Use of the polymer coil supports also provides more consistent core coolant (oil) flow, improved thermal performance and consistency, and improved mechanical performance because among other properties, it does not compress.

With respect to the polymer coil supports 310, 325, 340, and 355, various production methods may be used for providing dielectric coolant flow to the side ducts of the coils 105, 110, and 115. For example, the polymer coil support 310, which insulates the ends of coil 105 from the core 120 ground plane, provides minimal obstruction of coolant flow horizontally above and below the coil 105 in the core window 205 and provides for consistent coolant flow. The coil support 310 also provides mechanical support for the coil 105 in the core window 205. This support serves to prevent crushing of the coil margins. In addition, the coil support 310 is sufficiently rigid to withstand telescoping forces during a short circuit. A single sheet or multiple stacked sheets may be used. Where stacked sheets are used, the coil support 310 is designed to minimize the probability of individual layers moving axially in relation to each other during shipping or short circuit. The coil support 310 has sufficient dielectric strength in the core window 205. The coil support 310 may be made from a high temperature thermoplastic or a thermoset material.

Figure 4:
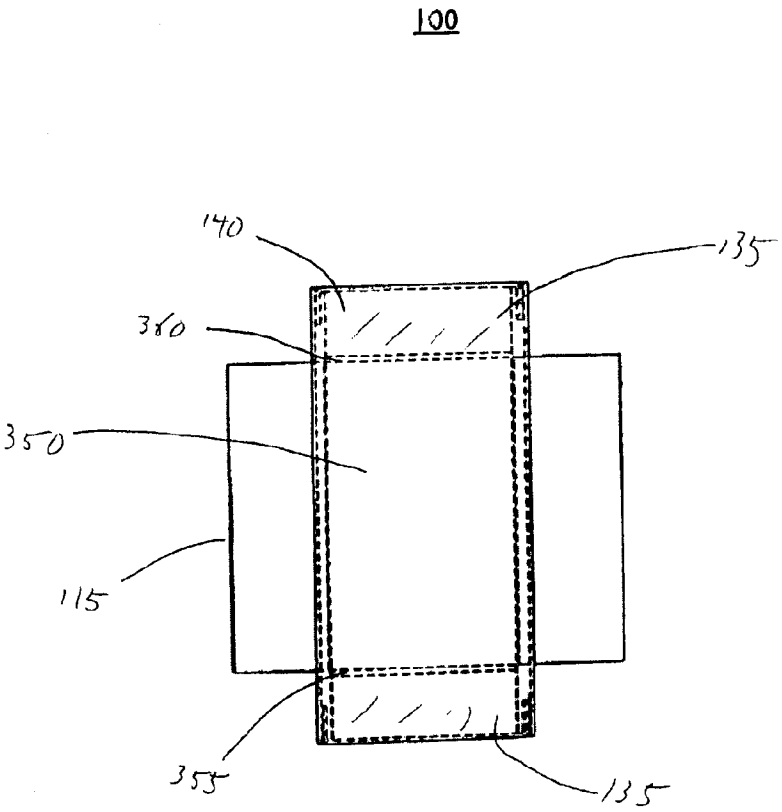
FIG. 4 is a cut-away end view of the three phase transformer core and coil assembly of FIGS. 1–3.

FIG. 4 shows a cut-away end view of the three phase transformer core and coil assembly of FIG. 1. FIG. 4 illustrates coil 115, core 135, barrier insulation 350, coil support 355, barrier insulation 360, and frame 140.

Figure 5:
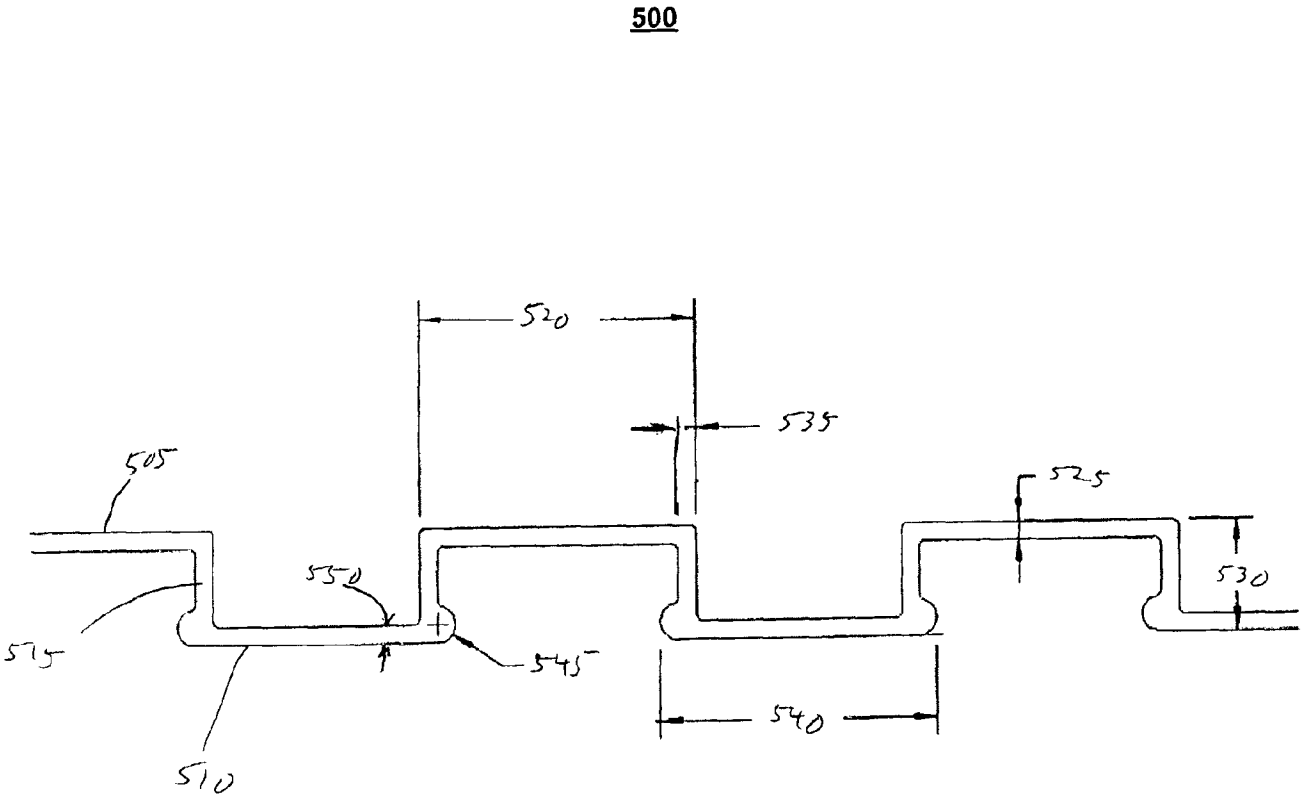
FIGS. 5, 7 and 8 are side views of corrugated barrier insulation that may be used in the three phase transformer core and coil assemblies of FIGS. 1–4.

FIG. 5 illustrates a side view of an exemplary corrugated barrier insulation that may be used in the three phase transformer core and coil assembly of FIGS. 1–4. For example, with respect to FIG. 3, the corrugated barrier insulation 500 may be used as barrier insulation 305, 320, 335, or 350 and/or barrier insulation 315, 330, 345, or 360. Corrugated barrier insulation 500 has upper faces 505 and lower faces 510 that are connected by transverse members 515. Protrusions 545 are provided at the lower face 510 in order to allow for stacking of multiple layers of corrugated barrier insulation 500. The upper face 505 has a length 520 and a thickness 525 that may be uniform or may vary. Transverse member 515 has a length 530 and a thickness 535 that may be uniform or may vary. The lower face 510 has a length 540 and a thickness 550 that may be uniform or may vary, and typically includes protrusions 545. Though not shown, top face 505 may also include protrusions. Corrugated barrier insulation 500 may be made from polymer materials as discussed above with respect to barrier insulation 305, 315, 320, 330, 335, 345, 350, and 360.

Figure 6:
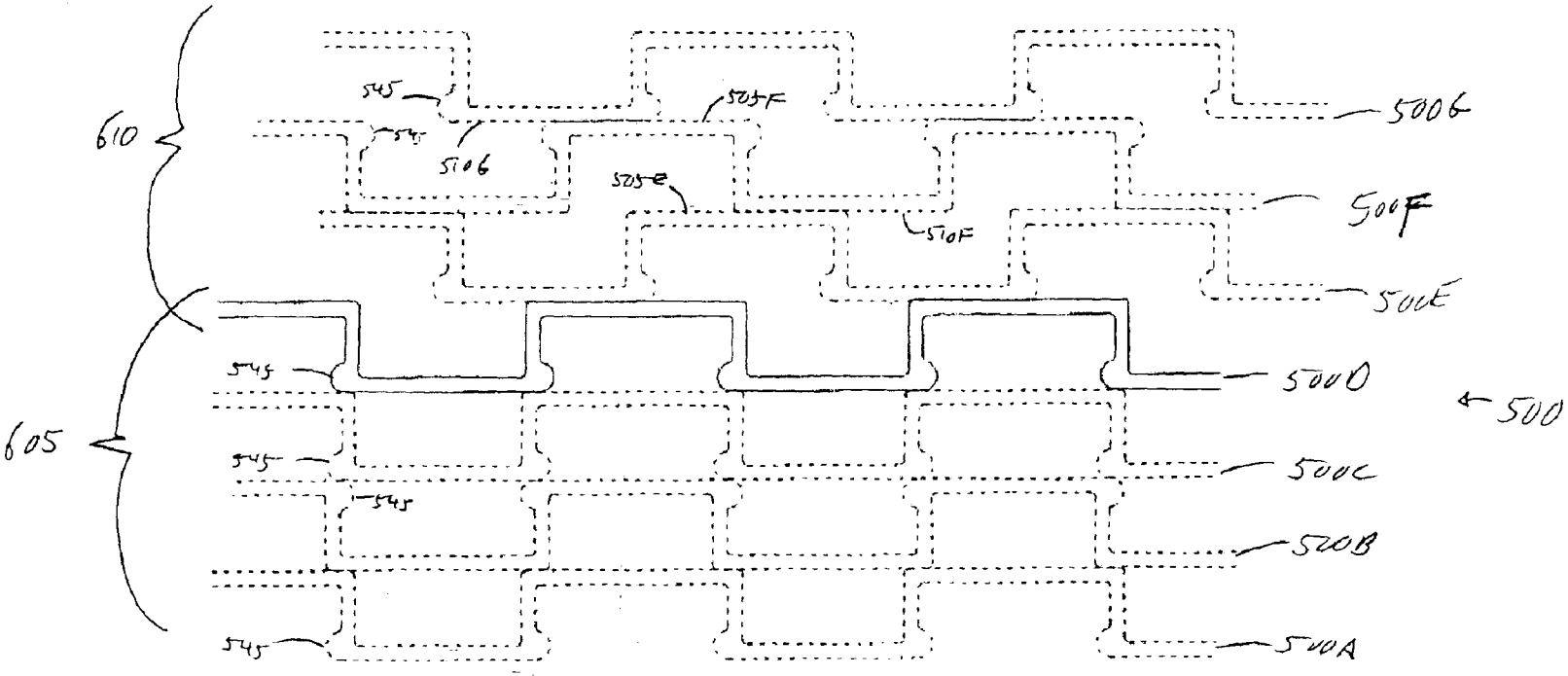
FIG. 6 is a side view of exemplary stacking configurations of the corrugated barrier insulation of FIG. 5

FIG. 6 shows a side view of a stacked configuration of multiple sheets of the corrugated barrier insulation of FIG. 5. The stack 600 of corrugated barrier insulation 500 sheets includes an aligned stack 605 of sheets 500A, 500B, 500C, and 500D, and also includes a staggered stack 610 of sheets 500E, 500F, and 500G. In the aligned stack 605, the upper faces of sheets 500A, 500B, 500C, and 500D are aligned, the lower faces of 500A, 500B, 500C, and 500D are aligned, and the transverse members of 500A, 500B, 500C, and 500D are aligned. The protrusions 545 assist in maintaining the stacked configuration of the corrugated barrier insulation sheets 500A, 500B, 500C, and 500D.

The staggered stack 610 includes sheets 500E, 500F, and 500G aligned in a staggered configuration. For example, corrugated barrier insulation sheet 500E is aligned to be offset with respect to the adjacent corrugated barrier insulation sheet 500F. A lower face 510F of sheet 500F is staggered with respect to a upper face 505E of sheet 500E, and an upper face 505F of sheet 500F is staggered with respect to a lower face 510G of sheet 500G The staggered pattern may continue as more layers are added. The number of layers in the stacked configuration will depend on, among other things, the dielectric strength required and the physical dimensions of the core and the coil.

Figure 7:
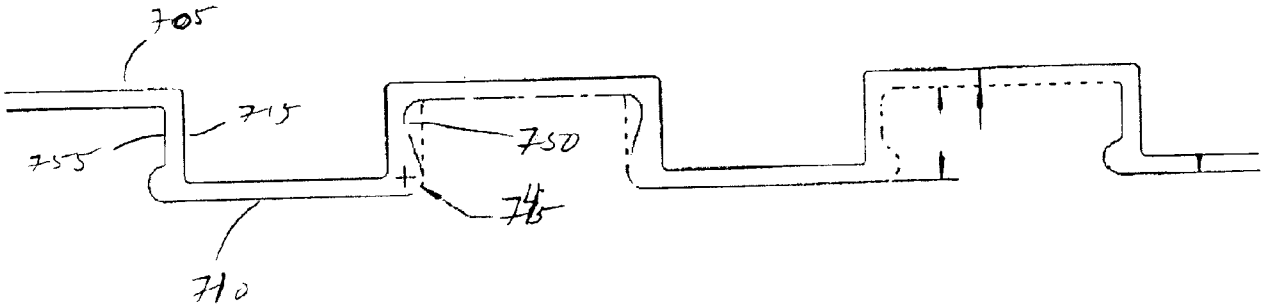

FIG. 7 shows a side view of another exemplary corrugated barrier insulation 700 that may be used in the three phase transformer core and coil assembly of FIGS. 1–4. Corrugated barrier insulation 700 includes upper faces 705 and lower faces 710 that are connected by transverse members 715. Protrusions 745 are provided at the lower face 710 in order to allow for stacking of multiple layers of corrugated barrier insulation 700. Though not shown, the upper face 705 may also include protrusions. The transverse member may be of uniform or non-uniform thickness. For example, an indentation 750 is formed in a transverse member 715 so that the transverse member has a non-uniform thickness.

Another transverse member 718 has a flat wall 755 so that the transverse member has a uniform thickness.

Figure 8:
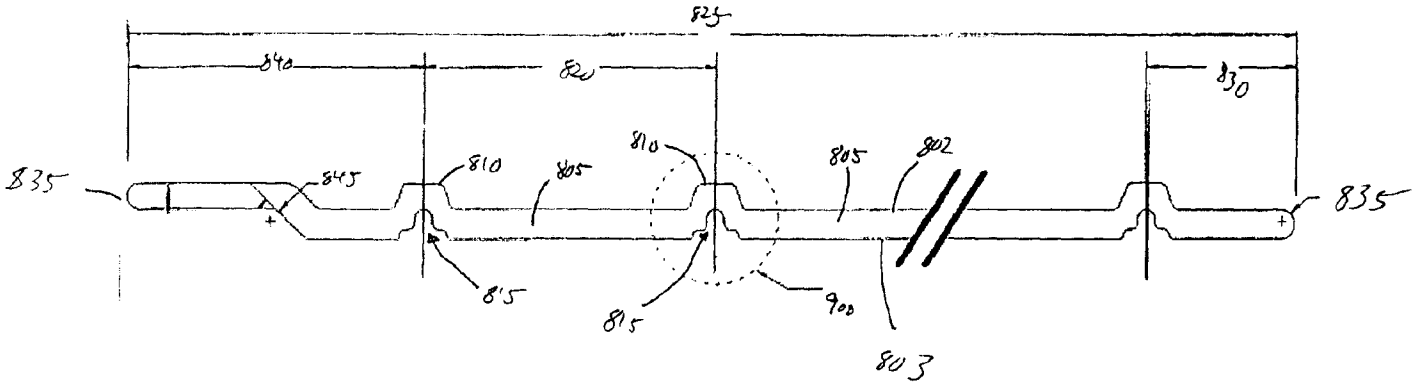

FIG. 8 illustrates a side view of yet another exemplary corrugated barrier insulation 800 that may be used in the three phase transformer core and coil assembly of FIGS. 1–4. Corrugated barrier insulation 800 includes flat regions 805 and ribs 810 located on an upper surface 802 of insulation 800. A rib 810 includes an indentation 815 located on a lower surface 803 of the insulation 800. Indentation 815 and rib 810 facilitate the stacking of multiple sheets of corrugated barrier insulation 800 and enable the stacked sheets to resist transverse motion with respect to each other. Corrugated barrier insulation 800 also includes a rounded end 835 and a raised section 845.

The corrugated barrier insulation 800 has an overall length 825 that may be divided into a set of one or more distances 820 between consecutive ribs 810, a distance 830 from a rib 810 to an end 835, and a distance 840 from a rib 810 to the other end 835.

Figure 9:
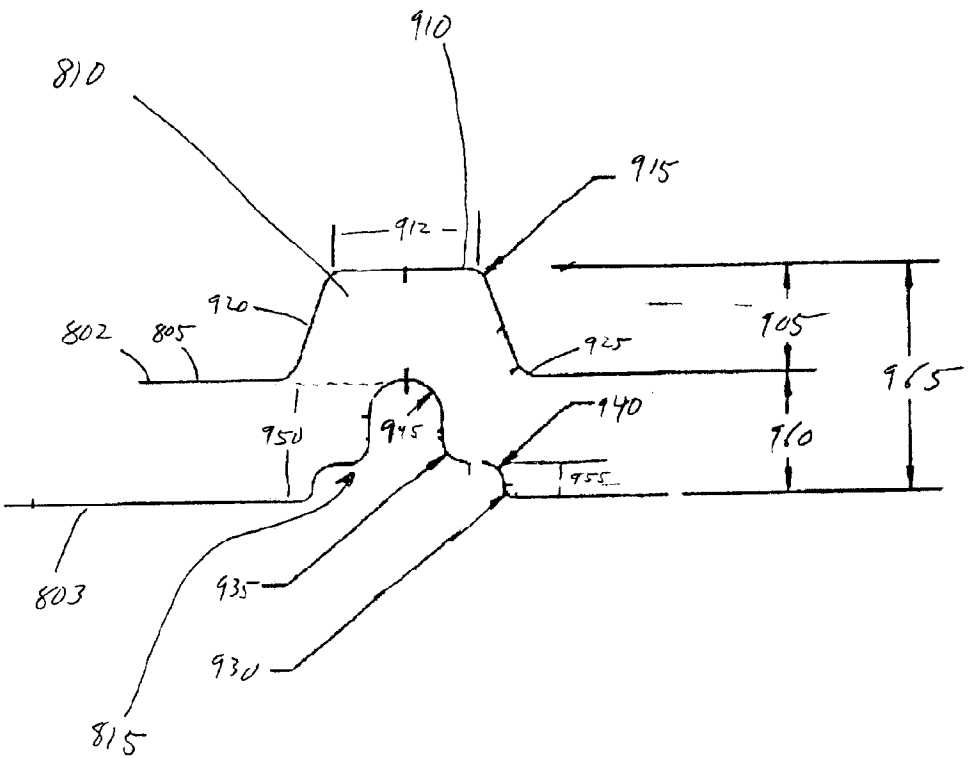
FIG. 9 is an expanded view of a section of the corrugated barrier insulation of FIG. 8.

FIG. 9 shows an expanded view of a section of the corrugated barrier insulation of FIG. 8 near a rib 810. The section 900 includes a rib 810 located on an upper surface 802, and an indentation 815 located on a lower surface 803. The indentation 815 has a shape that is configured to engage rib 810. The rib 810 has a height 905 above surface 802. The flat area 805 transitions to a rib 810 through a bottom curve 925 to a side 920 to a top curve 915 and to a rib top 910. The rib top 910 has a length 912. Although rounded corners are illustrated, other shapes, such as square corners or other angled corners, may be used. Also, the sides may have different shapes and slopes from those illustrated in FIG. 9.

The barrier insulation has a thickness 960 and a total height from the lower surface 803 to the rib top 910.

The indentation 815 has corners 930 to form an indentation of depth 955, and corners 935 to form a total depth 950. A recess 945 is optional. Although rounded corners are shown, various other shapes may be used for the indentation. Also, other shapes may be used for the rib 810 and the indentation 815.

As discussed, rib 810 and indentation 815 are configured to engage and enable stacking of multiple sheets 800 in such a manner that the sheets do not slide transversely with respect to one another when subjected to compressive loading forces. The combination of rib 810 and indentation 815, or other corrugated shapes, enables, among other benefits, easier stacking of multiple sheets, and prevents sliding of the various sheets in a stack with respect to each other.

Figure 10:
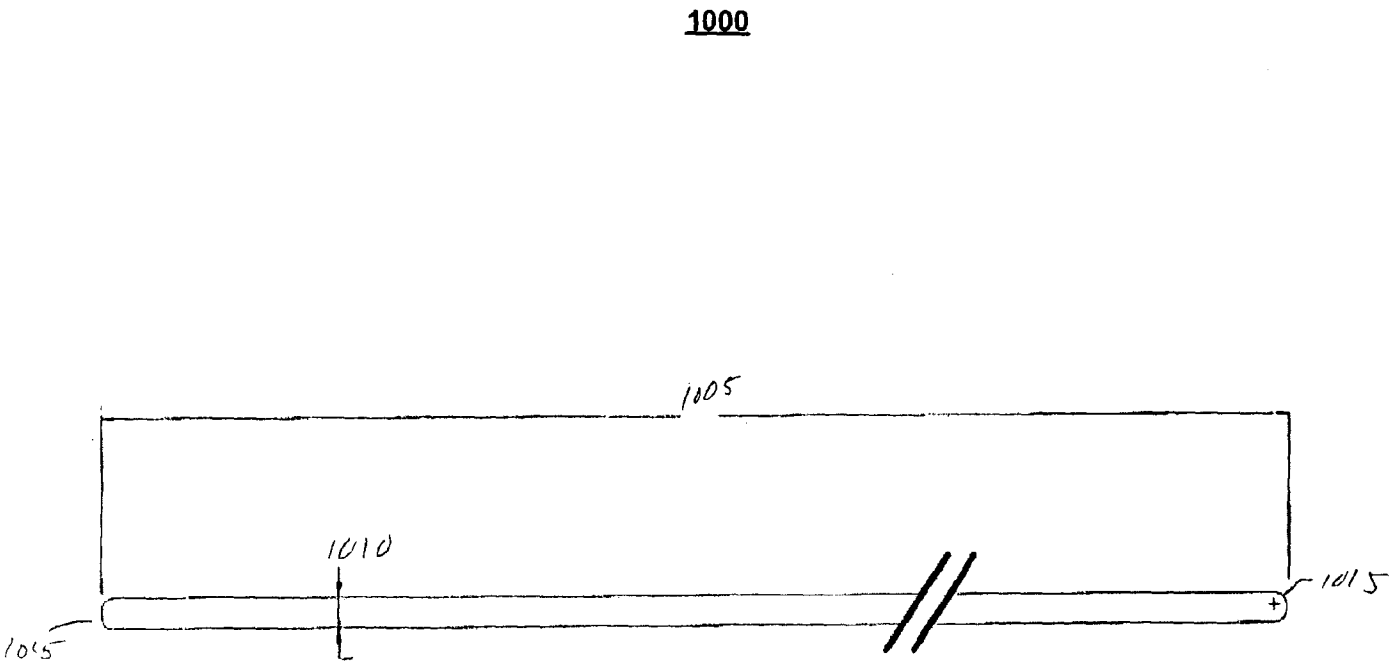
FIG. 10 is a side view of flat barrier insulation that may be used in the three phase transformer core and coil assemblies of FIGS. 1–4.

FIG. 10 shows a side view of flat barrier insulation that may be used in the three phase transformer core and coil assembly of FIGS. 1–4. Flat barrier insulation 1000 has no corrugation (i.e., no ribs or indentations). Flat barrier insulation 1000 has a thickness 1010 and an overall length 1005. Flat barrier insulation 1000 also includes optional rounded corners 1015. Although flat and corrugated shapes have been shown, other shapes of barrier insulation sheets may be used.

Figure 11:
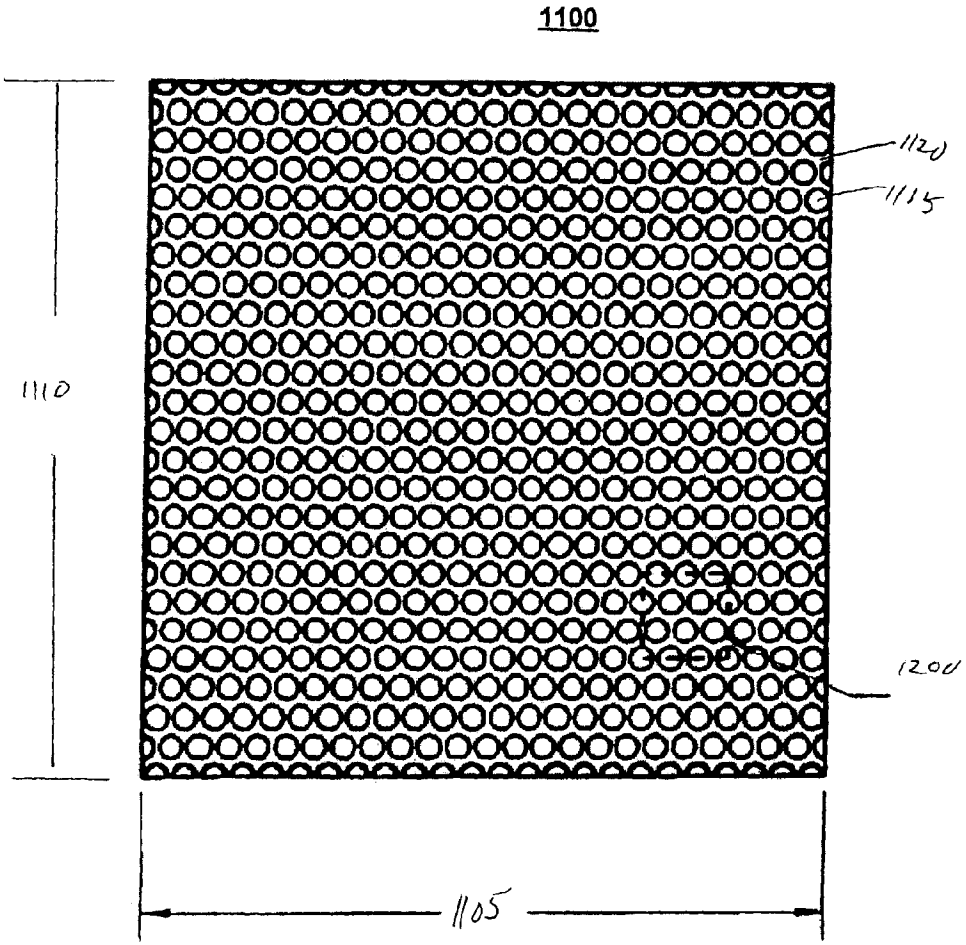
FIGS. 11 and 14 are top views of coil supports that may be used in the three phase transformer core and coil assemblies of FIGS. 1–4.

FIG. 11 shows a top view of an exemplary coil support that may be used in the three phase transformer core and coil assembly of FIGS. 1–4. For example, referring to FIG. 3, coil support 1100 may be used as any or all of coil supports 310, 325, 340, and 355. Coil support 1100 has a length 1105 and a width 1110. Although coil support 1100 is shown as a rectangular shape, other shapes may be used. Coil support 1100 has standoffs 1115 and channels 1120 between the standoffs that provide for coolant flow above and/or below the coil support 1100.

Figure 12:
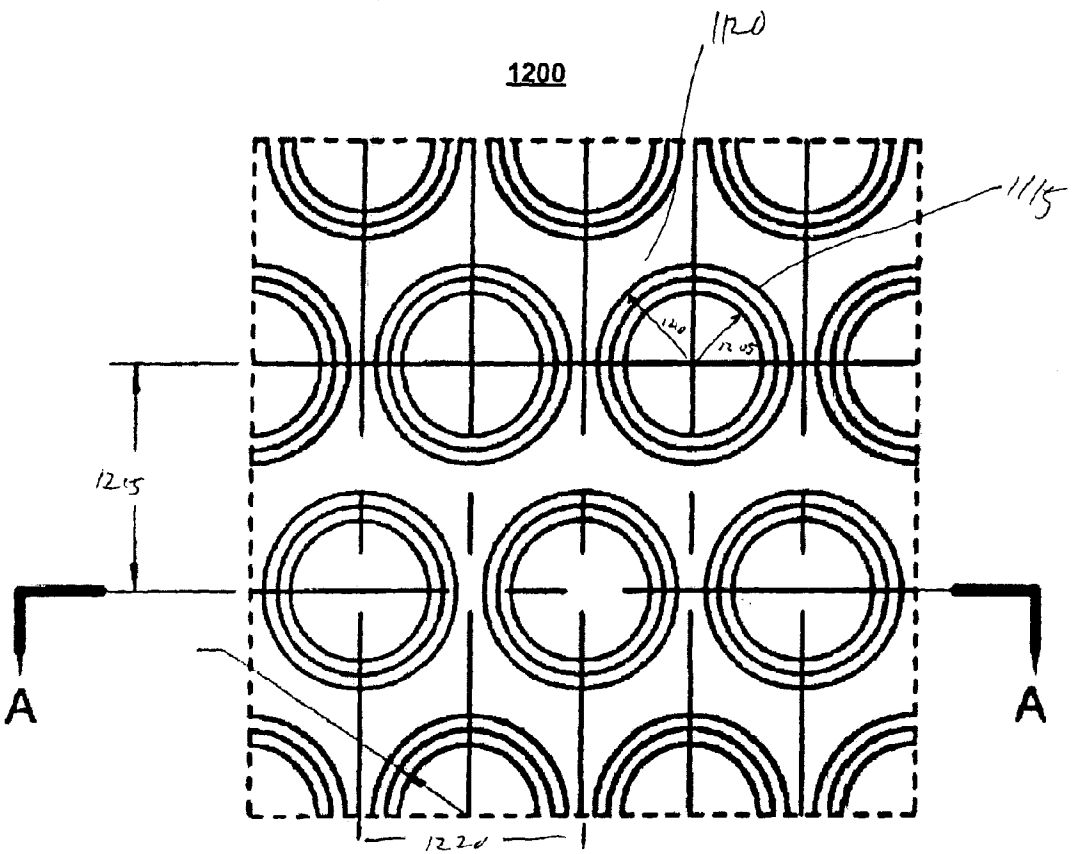
FIG. 12 is an expanded top view of a section of the coil support of FIG. 11.

FIG. 12 shows an expanded top view of a section of the coil support of FIG. 11. Section 1200 of the coil support shows a topographical view of standoffs 1115 and channels 1120. There is a spacing 1215 between standoffs in the vertical direction and a spacing 1220 between standoffs in the horizontal direction. The spacings 1215 and 1220 may be uniform or may vary. The standoffs 1115 may include an inner radius 1205 and an outer radius 1210, with the inner radius being at the highest elevation in the topographical view and the outer radius being at the lowest elevation in the topographical view.

Figure 13:
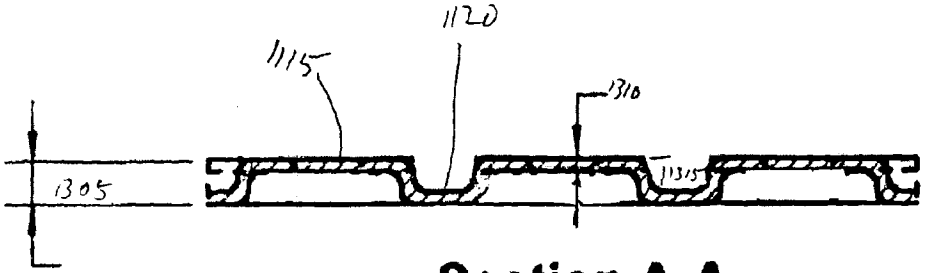
FIG. 13 is a cross-sectional view of the coil support of FIG. 12 taken along section A—A of FIG. 12.

FIG. 13 is a cross-sectional view of the coil support of FIG. 12 taken along section A—A of FIG. 12. FIG. 13 shows three standoffs 1115 and two channels 1120. Each standoff 1115 has a height 1305 and each channel 1120 has a depth 1315. In particular implementations, the height 1305 and depth the 1315 may be uniform or may vary. The polymer sheets forming standoffs 1115 and channels 1120 have a thickness 1310, which may be uniform or variable.

Figure 14:
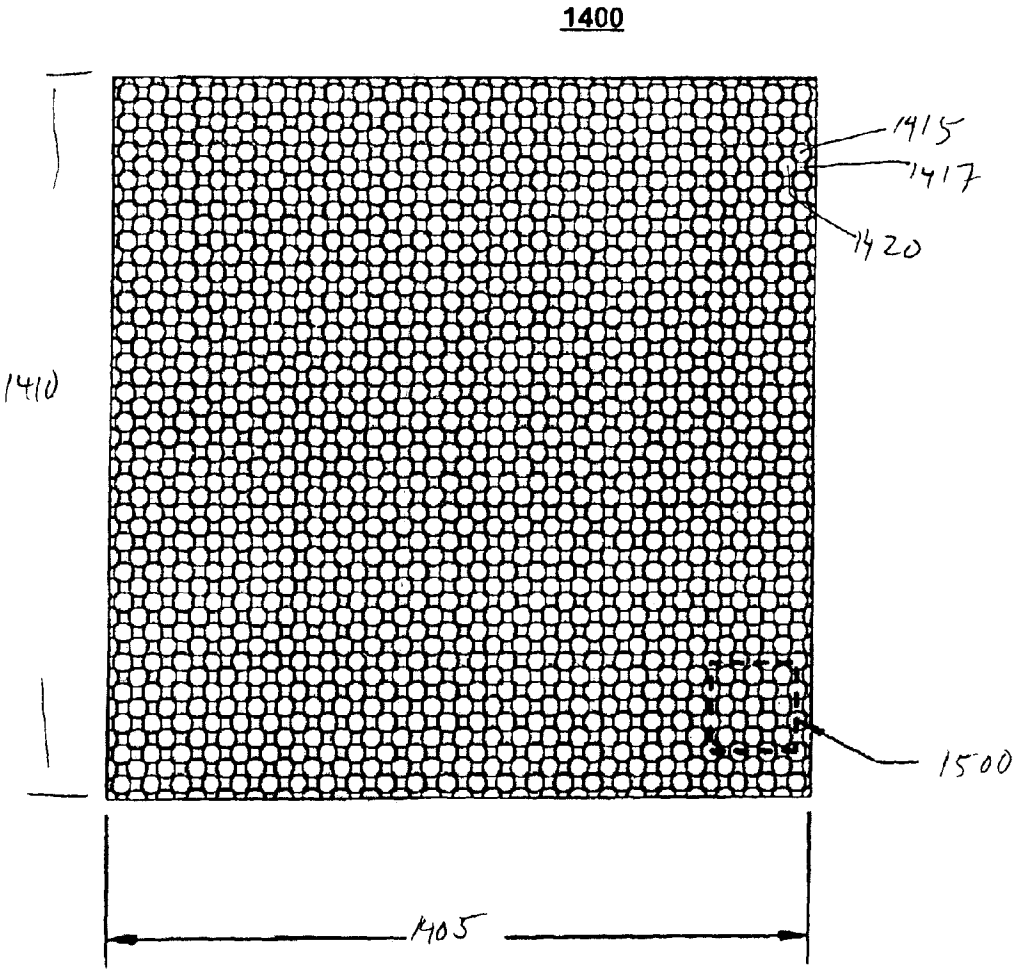

FIG. 14 shows a top view of another exemplary coil support that may be used in the three phase transformer core and coil assembly of FIGS. 1–4. Coil support 1400 has a length 1405 and width 1410. Although shown in a rectangular shape, other shapes may be used. Coil support 1400 has standoffs 1415 of a first type and standoffs 1417 of a second type. Coil support 1400 also has channels 1420 that run between the standoffs 1415 and 1417.

Figure 15:
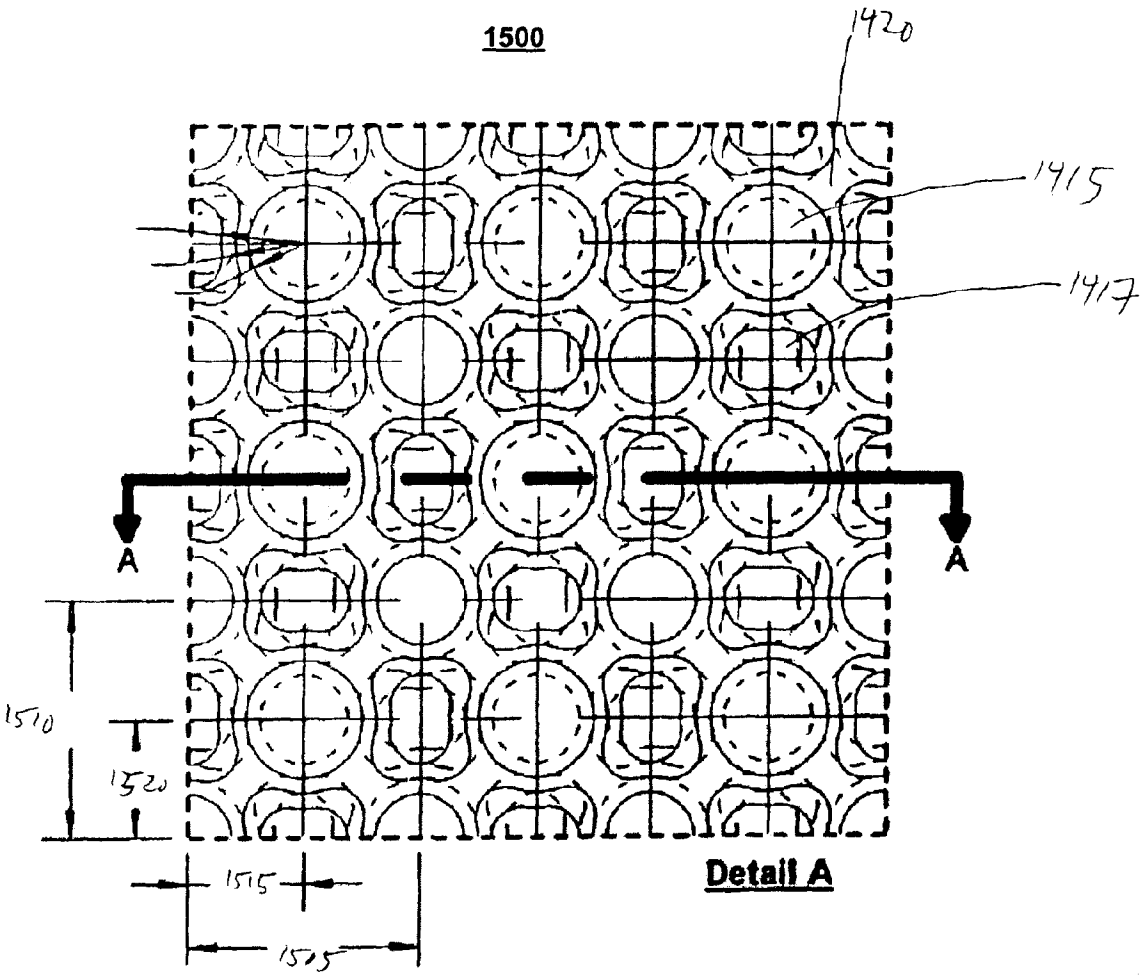
FIG. 15 is an expanded top view of a section of the coil support of FIG. 14.

FIG. 15 is an expanded top view of a section of the coil support of FIG. 14. The section 1500 shows standoffs 1415 of a first type, which in this case is a circular type, and standoffs 1417 of a second type, which in this case is a truncated circular type. Channels 1420 are formed between the standoffs 1415 and 1417.

Although FIG. 15 shows a pattern of alternating standoffs 1415 and 1417, other implementations may use other patterns. For example, two or more standoffs of a first type 1415 may be placed adjacent to each other, rather than alternating between standoffs of a first type and a second type. FIG. 15 shows a horizontal standoff spacing 1505 between the same type of standoff 1417 and a horizontal standoff spacing 1515 between different types of standoffs. Similarly, there is a vertical spacing 1510 between the same type of standoff and a vertical spacing 1520 between alternating types of standoffs. In particular implementations, the horizontal and vertical spacings may be uniform or variable.

Figure 16:
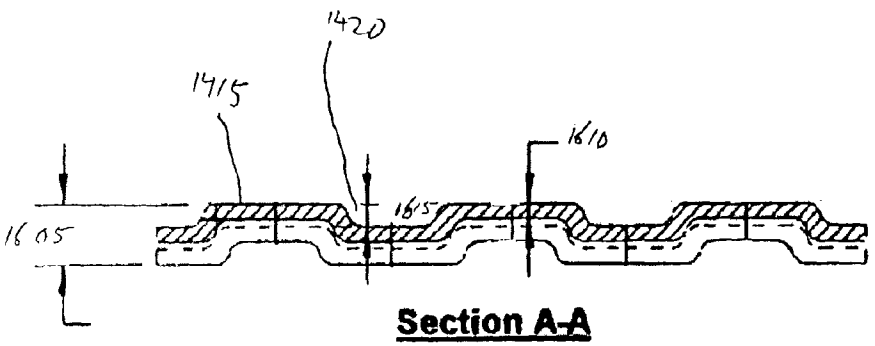
FIG. 16 is a cross-sectional view of the coil support of FIG. 15 taken along section A—A of FIG. 15.

FIG. 16 shows a cross-sectional view of a section of coil support of FIG. 15 taken along section A—A of FIG. 15. FIG. 16 shows standoffs of a first type 1415 and channels 1420. Due to the cross-section shown, a standoff of the second type 1417 is not shown. Standoff 1415 has a height 1605 and channel 1420 has a depth 1615. In particular implementations, height 1605 and depth 1615 may be uniform or variable. The polymer sheet in which standoff 1415 and channel 1420 are formed has a thickness 1610 that may be uniform or may vary.

Figure 17:
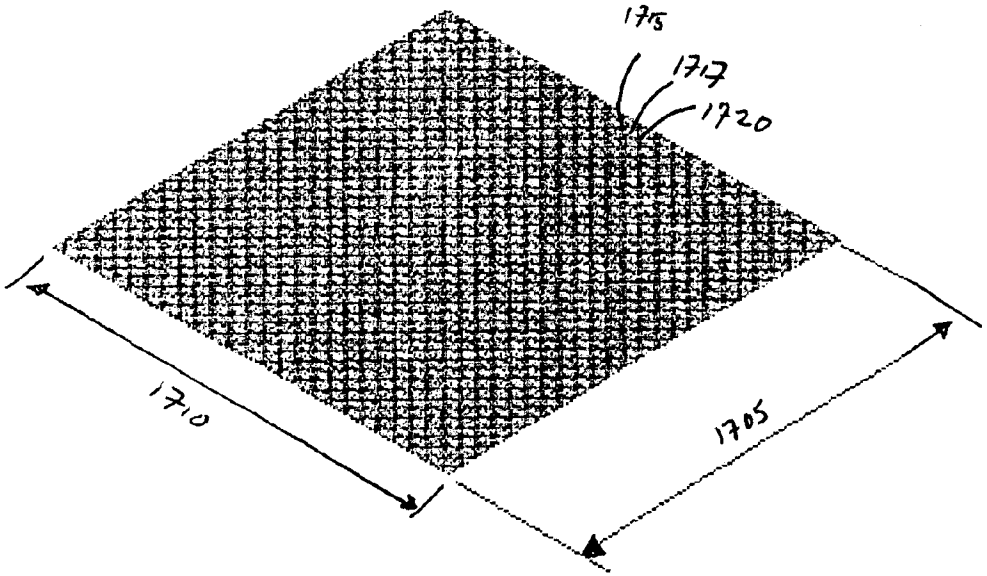
FIG. 17 is a perspective view of a coil support that may be used in the three phase transformer core and coil assemblies of FIGS. 1–4.

FIG. 17 shows a perspective view of yet another exemplary coil support that may be used in the three phase transformer core and coil assembly of FIGS. 1–4. Coil support 1700 has a length 1705 and a width 1710. Although shown in a rectangular configuration, other shapes may be used. Coil support 1700 has standoffs 1715 and dimples 1717. Channels 1720 are formed between the standoffs 1715 and the dimples 1717 to enable coolant flow above and/or below the coil support 1700.

The shape of the coil support 1700 is symmetric in the x and the y directions, and has the same shape on the top and the bottom. This allows for installation without regard to orientation. The coil support 1700 is of uniform wall thickness, improving material flow characteristics during the molding process. The repetitive design assists with tooling construction. This shape provides a high degree of flow area for the dielectric coolant and tends to minimize the potential for continuous blockage of any single coolant flow channel in the coil support 1700.

Figure 18:
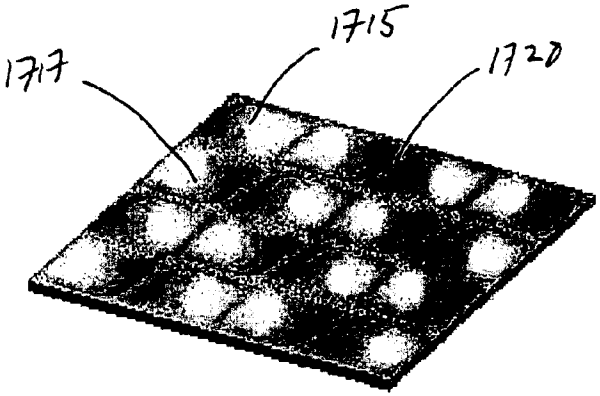
FIG. 18 is an expanded perspective view of a section of the coil support of FIG. 17.

FIG. 18 shows an expanded perspective view of a section of the coil support of FIG. 17. Section 1800 shows one or more standoffs 1715, dimples 1717, and channels 1720.

Figure 19:
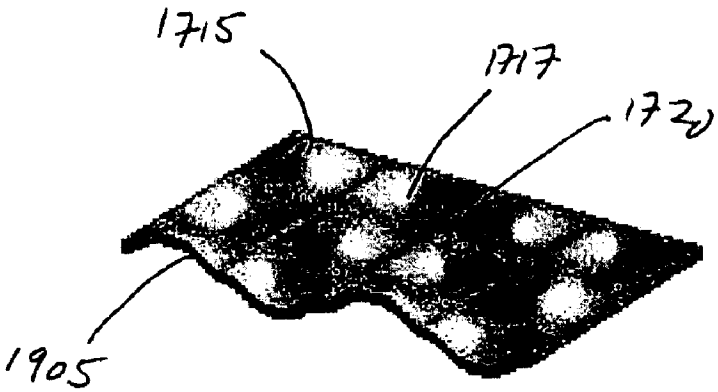
FIG. 19 is a perspective cross-sectional view of the coil support of FIG. 18.

FIG. 19 shows a perspective cross-sectional view of the coil support of FIG. 18. Cross-section 1905 shows standoffs 1715 and dimples 1717 in a profile view.

Figure 20:
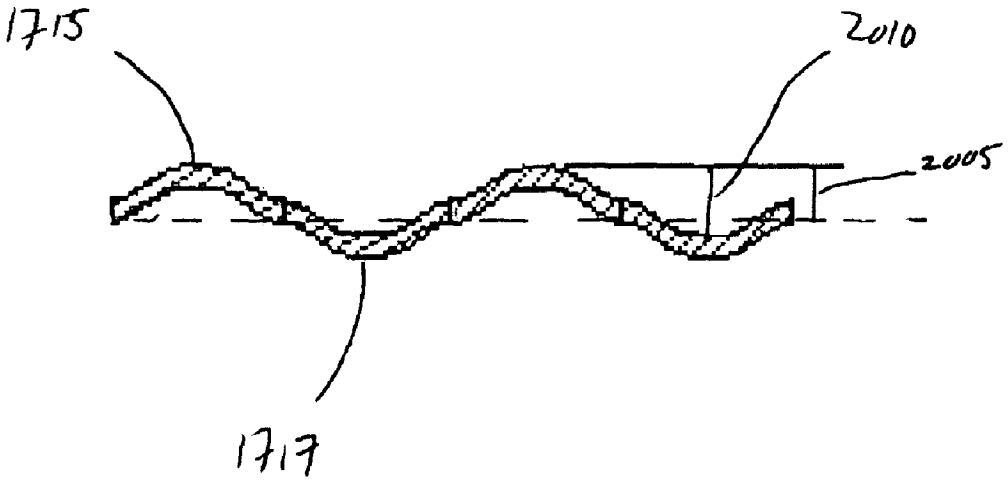
FIG. 20 is a cross-sectional view of the coil support of FIG. 18.

FIG. 20 shows a cross-sectional view of the coil support of FIG. 18. FIG. 20 shows one or more standoffs 1715 and one or more dimples 1717. Each standoff 1715 has a height 2005 and each dimple 1717 has a depth 2010.

Other implementations are within the scope of the following claims.

What is claimed is:

1. A transformer comprising:

a core defining a core window;

a first coil surrounding a portion of the core and including a portion located within the core window;

a second coil surrounding a portion of the core and including a portion located within the core window;

a coil support member located at least partially within the core window and positioned between the first coil and the core so as to support the first coil; and a polymer barrier insulation member, separate from the coil support member, that is formed from a polymer material, located at least partially within the core window, and positioned between the first coil and the second coil.

2. The transformer of claim 1, wherein the transformer comprises a three-phase transformer.

3. The transformer of claim 1, wherein the transformer comprises a single-phase transformer.

4. The transformer of claim 1, wherein the transformer comprises a step voltage regulator.

5. The transformer of claim 1, wherein the polymer barrier insulation member comprises at least one ribbed polymer sheet.

6. The transformer of claim 1, wherein the polymer barrier insulation member comprises at least one flat polymer sheet.

7. The transformer of claim 1, wherein the polymer barrier insulation member comprises two or more stacked polymer sheets.

8. The transformer of claim 1, wherein the polymer material comprises a high temperature polymer configured to withstand an operating temperature of approximately 130 degrees Celsius.

9. The transformer of claim 8, wherein the polymer material is configured to withstand overload conditions through approximately 200 degrees Celsius.

10. The transformer of claim 8, wherein the polymer material is configured to absorb no more than approximately 1% moisture.

11. The transformer of claim 1, wherein the polymer material comprises syndiotactic polystyrene.

12. The transformer of claim 11, wherein the syndiotactic polystyrene is extruded.

13. The transformer of claim 11, wherein the syndiotactic polystyrene is injection molded.

14. The transformer of claim 11, wherein the syndiotactic polystyrene is thermo-formed.

15. The transformer of claim 1, wherein the polymer material comprises a polyester thermoset molding compound.

16. The transformer of claim 15, wherein the thermoset is extruded.

17. The transformer of claim 15, wherein the thermoset is compression molded.

18. The transformer of claim 15, wherein the thermoset is injection molded.

19. The transformer of claim 1, wherein the polymer material comprises a vinylester thermoset molding compound.

20. The transformer of claim 19, wherein the thermoset is extruded.

21. The transformer of claim 19, wherein the thermoset is compression molded.

22. The transformer of claim 19, wherein the thermoset is injection molded.

23. A transformer comprising:

a core defining a core window;

a first coil surrounding a portion of the core and including a portion located within the core window;

a coil support member located at least partially within the core window and positioned between the first coil and the core so as to support the first coil; and a polymer barrier insulation member, separate from the coil support member, that is formed from a polymer material, located at least partially within the core window, and positioned between the first coil and the core.

24. The transformer of claim 23, wherein the transformer comprises a three-phase transformer.

25. The transformer of claim 23, wherein the transformer comprises a single-phase transformer.

26. The transformer of claim 23, wherein the transformer comprises a step voltage regulator.

27. The transformer of claim 23, wherein the polymer barrier insulation member comprises at least one ribbed polymer sheet.

28. The transformer of claim 23, wherein the polymer barrier insulation member comprises at least one flat polymer sheet.

29. The transformer of claim 23, wherein the polymer barrier insulation member comprises two or more stacked polymer sheets.

30. The transformer of claim 23, wherein the polymer material comprises a high temperature polymer configured to withstand an operating temperature of approximately 130 degrees Celsius.

31. The transformer of claim 30, wherein the polymer material comprises syndiotactic polystyrene.

32. The transformer of claim 31, wherein the syndiotactic polystyrene is extruded.

33. A transformer comprising:

a core defining a core window;

a first coil surrounding a portion of the core and including a portion located within the core window; and a polymer coil support member that is formed from a polymer material, located at least partially within the core window, and positioned between the first coil and the core so as to support the first coil, wherein the coil support member comprises one or more standoffs.

34. The transformer of claim 33 further comprising a second coil surrounding a portion of the core and including a portion located within the core window, wherein the coil support is positioned between the second coil and the core so as to support the second coil.

35. The transformer of claim 33, wherein the standoff has a circular shape.

36. The transformer of claim 33, wherein the standoff has a truncated circular shape.

37. The transformer of claim 33, wherein the standoff has an egg crate shape.

38. The transformer of claim 33, wherein the coil support member comprises one or more coolant flow channels.

39. The transformer of claim 33, wherein the polymer material comprises a thermoset material.

40. The transformer of claim 33, wherein the polymer material comprises a high temperature thermoplastic material.

41. The transformer of claim 33, wherein the polymer material comprises a high temperature polymer material configured to withstand an operating temperature of approximately 130 degrees Celsius.

42. A transformer comprising:

a core defining a core window;

a first coil surrounding a portion of the core and including a portion located within the core window;

a second coil surrounding a portion of the core and including a portion located within the core window;

a first polymer barrier insulation member that is located at least partially within the core window and positioned between the first coil and the second coil;

a second polymer barrier insulation member that is located at least partially within the core window and positioned between the first coil and the core; and a polymer coil support member that is located at least partially within the core window and positioned between the first coil and the core so as to support the first coil, wherein the coil support member comprises one or more standoffs.

* * * * *